United States Patent [19]

Ruegg

[11] 4,350,102

[45] Sep. 21, 1982

[54] COMBINED COMBUSTION AND MELTING FURNACE FOR SOLID, PASTY AND LIQUID WASTE MATERIALS

[75] Inventor: Hans Ruegg, Wettingen, Switzerland

[73] Assignee: Von Roll AG, Gerlafingen, Switzerland

[21] Appl. No.: 241,116

[22] Filed: Mar. 6, 1981

[51] Int. Cl.[3] ..... F23G 5/06

[52] U.S. Cl. ..... 110/246; 110/212; 110/214; 414/149; 432/72; 432/106

[58] Field of Search ..... 110/246, 258, 346, 211, 110/212, 214; 432/103, 106, 72; 414/149

[56] References Cited

U.S. PATENT DOCUMENTS

| | | | |
|---|---|---|---|
| 3,785,306 | 1/1974 | Jaget | 110/246 X |
| 3,906,874 | 9/1975 | Jaromko et al. | 110/246 X |
| 4,313,712 | 2/1982 | Seglias | 414/149 |

FOREIGN PATENT DOCUMENTS

| | | | |
|---|---|---|---|
| 1900362 | 8/1970 | Fed. Rep. of Germany | 110/246 |
| 2428961 | 1/1975 | Fed. Rep. of Germany | 110/246 |

*Primary Examiner*—Edward G. Favors

*Attorney, Agent, or Firm*—Weingarten, Schurgin & Gagnebin

[57] ABSTRACT

A rotatable drum is equipped at a front end with a burner for liquid waste materials and at a rear end has a tiltable charging mechanism for solid waste materials and waste materials stored in barrels. The rear end of the drum is sealed by a fixed casing enveloping the charging mechanism. Adjacent that end there is a gas outlet projecting through a dome-like gas inlet connection of a fixed secondary combustion chamber. The drum shell is stepped such that a refractory lining of the semicylindrical lower drum part cooled by means of water spray nozzles is thinner than a refractory brick material of the semicylindrical drum upper part by an amount equal to the depth of the drum step. Due to rotationally reciprocating or rocking movement of the drum, the waste materials undergo pyrolysis, the pyrolysis gases flowing through a gas outlet into the secondary combustion chamber. In the case of a particularly high combustion speed of the waste materials, the combustion air is blown in through combustion chamber nozzles, instead of through the drum burners. This displaces the combustion process into the secondary combustion chamber, which leads to a temperature drop in the drum and to a slowing down of the pyrolysis of the material to be burned. As a result of a drum emptying rotation of 180°, the combustion residues melted by means of the drum burner are discontinuously removed through the gas outlet.

8 Claims, 2 Drawing Figures

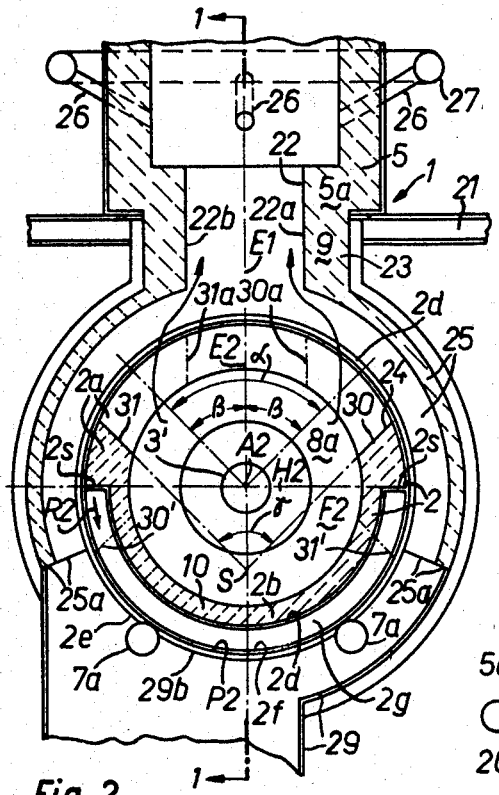
Fig. 2
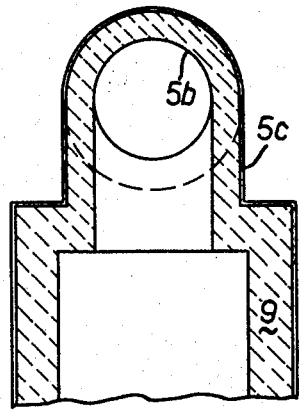
Fig. 1
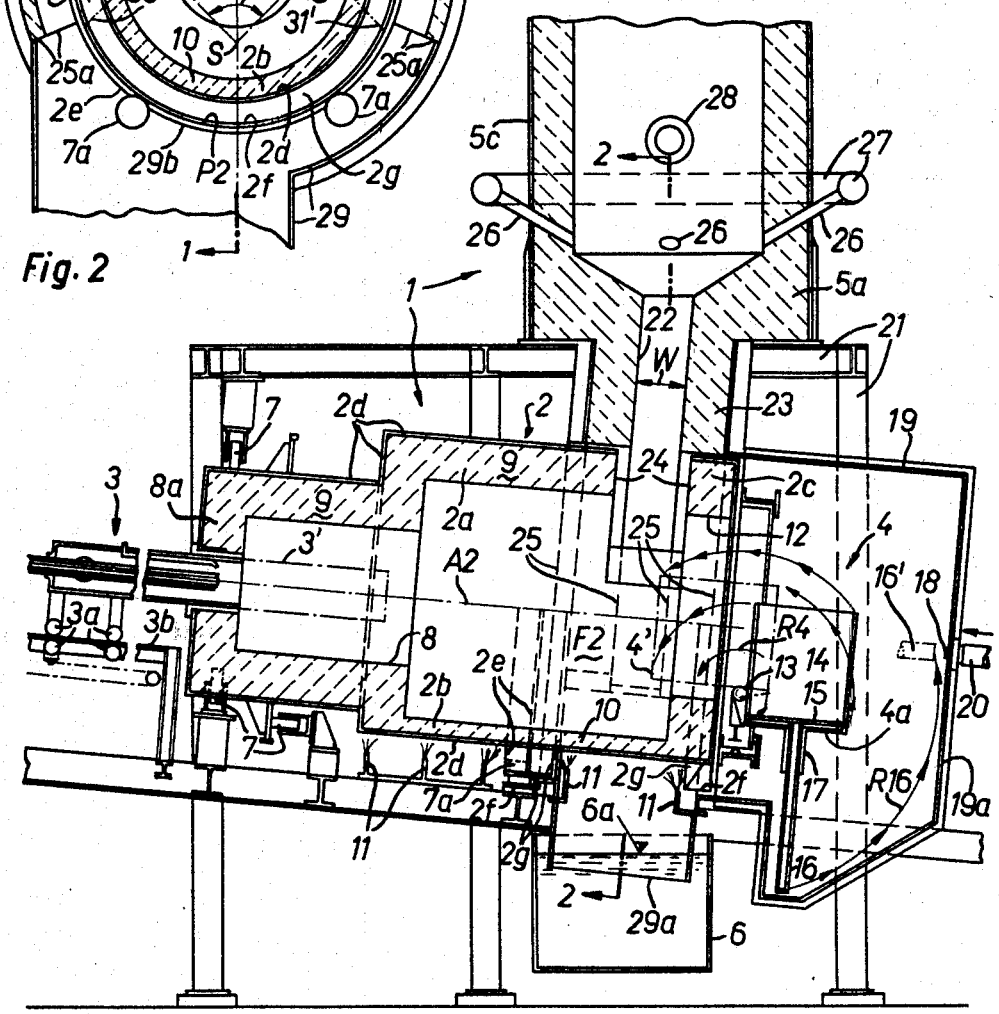

COMBINED COMBUSTION AND MELTING FURNACE FOR SOLID, PASTY AND LIQUID WASTE MATERIALS

FIELD OF THE INVENTION

This invention relates generally to a combined combustion and melting furnace and is more specifically concerned with such a furnace having a secondary combustion chamber.

BACKGROUND OF THE INVENTION

In known furnaces used exclusively for burning waste materials, a charging mechanism for continuously charging the furnace with base materials is positioned on the front, higher end face of a drum provided with a charging opening and performing a rocking movement. The rear, open end of the drum, which is lined with refractory material, opens into the vertically positioned fixed secondary combustion chamber lined with a refractory material. One or more rows of nozzles for introducing the combustion air are centrally arranged on the upper shell portion of the furnace drum in the vicinity of its vertical median plane and extend over at least part of the shell length. An example of such a furnace is shown in Swiss Pat. No. 440,526.

A combined combustion and melting furnace for burning waste materials of all types, particularly garbage, is known in which a trough-shaped base containing material to be burned has an overflow edge for removing the molten slag and is arranged in a tank which is incorporated into the front part of the furnace and which has a horizontal or inclined longitudinal axis, and this tank is adapted to rotate about its longitudinal axis. Oxygen-enriched, preheated combustion air is blown into the furnace combustion chamber and against the trough-shaped base through nozzles which are incorporated into the upper wall portion of the front furnace part and which are directed downwardly from above. An example of such a furnace is found in Swiss Pat. No. 411,198.

However, these known furnaces for only burning or for both burning and melting of waste materials have the disadvantage that, particularly because of the different combustion speeds of the different waste materials, the units downstream of the furnace such as the waste heat boiler, flue gas cleaner and exhauster are subject to a widely fluctuating, that is, non-uniform, flue gas flow. This produces a particularly unfavorable result in the case of a heat utilization (waste heat) boiler designed for a specific and preferably constant flow capacity and thermal efficiency. However, it is also undesirable to dimension the other units downstream of the furnace in accordance with the maximum gas flow.

SUMMARY OF THE INVENTION

It is an object of this invention to overcome these disadvantages by providing a combined combustion and melting furnace which, despite differing combustion rates resulting from different characteristics of the various waste materials, such as their calorific power, moisture content and proportion of incombustible inert materials, achieves a flue gas flow which remains substantially constant when the furnace is in operation and therefore provides a uniform loading of the units downstream of the furnace such as boilers, scrubbers and exhausters.

The invention relates generally to a combined combustion and melting furnace for solid, pasty and liquid waste materials. A drum, lined with refractory material serving as a support for the material to be burned and having a horizontal or inclined longitudinal axis, rotates on rollers and can be rocked about the longitudinal axis by means of a drive to stir up the material to be burned. A charging mechanism for the solid waste materials is positioned on one end face of the drum. In the vicinity of its lower, rear end, the drum is connected to a vertically positioned, fixed secondary combustion chamber.

This invention includes: a forwardly tiltable charging mechanism arranged outside a rear end wall of the drum which has a charging opening for the batchwise charging of the furnace with solid waste materials and waste materials stored in drums; a burner for liquid waste materials arranged coaxially with the drum axis on a burner anted amber which is disposed at the front end of the drum; a secondary combustion chamber whose base is provided with a gas inlet connection which has an inlet permanently connected to a gas outlet at the upper end of the drum during reciprocating movement of the drum; a refractory brickwork and insulation on the upper part of the drum and on the burner anted amber; a lining on the lower part of the drum of a refractory ceramic material; stationary water spray nozzles positioned outside of the lower drum lining and directed against the drum periphery; and a water-filled granulating tank for the discontinuous removal of molten combustion residues from the drum through the gas outlet in the upper end of the drum by rotation of the drum 180° from its central position.

As a result, the units connected downstream of the furnace are now exposed to a flue gas flow with a constant gas volume which, when compared with conventional furnaces, permits smaller and therefore less expensive downstream units, while considerably improving the operating conditions, particularly for the waste heat boiler.

BRIEF DESCRIPTION OF THE DRAWING

The invention will be more fully understood from the following detailed description of non-limiting embodiments when read in conjunction with the accompanying drawing in which:

FIG. 1 is a combined combustion and melting furnace for solid, pasty and liquid waste materials in a vertical longitudinal cross-section taken along the line 1—1 of FIG. 2; and FIG. 2 is a vertical cross-section taken along the line 2—2 of FIG. 1.

DETAILED DESCRIPTION OF THE PREFERRED EMBODIMENTS

With reference to FIG. 1, there is shown a combined combustion and melting furnace 1 for solid, pasty and liquid waste materials. This furnace includes a drum 2 which performs a rotationally reciprocating or rocking movement during operation and which is provided on a front end with a burner 3 for liquid waste materials and on a rear end with a tiltable charging mechanism 4 for solid waste materials and pasty waste materials stored in barrels. In the vicinity of its rear end drum 2 is connected to a vertically positioned, stationary secondary combustion chamber 5. By means of a 180° rotation drum 2 can be pivoted from its central position for the discontinuous or selective removal of the molten combustion residues to a water-filled granulating tank 6.

Drum 2 and secondary combustion chamber 5 form the main components of the combined combustion and melting furnace 1.

Drum 2 is rotatably disposed on rollers 7, 7a and has a longitudinal axis A2 which is shown rearwardly inclined with respect to the horizontal. The axis of the drum could also be horizontal if desired. Drum 2 can be rotated in a reciprocating manner about axis A2 to stir up the material to be burned in the drum by drive means of known type. The drive means is not shown in FIG. 1 for reasons of clarity. The angle of rotation $\alpha$ of the rocking movement of drum 2 shown as case 90°, the drum being movable from its central position shown in FIG. 1 to either side by an angle $\beta$ of 45° (see FIG. 2). However, the angle of rotation could differ from that shown. The drum drive, which should be as simple as possible, preferably includes a cable line which can be moved by a hydraulic or pneumatic drive in a manner known to those skilled in the art.

At its higher front end drum 2 is provided with a circular burner anted amber 8 arranged coaxially about drum axis A2 and which seals drum 2 at its front end wall 8a. A stationary burner 3 for liquid waste materials, such as solvents, waste oil or water/oil mixtures, is also positioned coaxially about drum axis A2. The combustion air is blown into drum 2 through burner 3. The casing of burner 3 is movably mounted on a guide bar 3bby means of rollers 3a for the axial adjustment of the burner. This burner can be moved to a rearwardly limited position 3' as indicated by the broken lines in FIG. 1.

The upper part 2a of drum 2 and the burner anted amber 8 are also rotated during the reciprocating movement of drum 2. Upper part 2a and burner anted amber 8 are brick-lined and insulated with a refractory material 9, while the semicylindrical lower drum part 2b is provided with a refractory lining 10, whose thickness is considerably less than that of material 9 (see also FIG. 2). The exterior of lower drum part 2b is cooled by means of water from spray nozzles 11. The water-cooled lining 10 ensures that during the melting phase a film of solidified slag is formed on the ramming surface, preventing the lining 10 from being destroyed by molten slag. A steel heat shell 2d envelopes drum 2 and burner anted amber 8.

The transition from the refractory material 9 of drum 2 to the thinner lining 10 occurs at a step 2s (FIG. 2) of the cylindrical drum shell 2d on the outer drum circumference. The semicylindrical lower drum part 2b has a much smaller diameter than the semicylindrical upper drum part 2a, a feature which is particularly noticeable in FIG. 2. Because step 2s is located on the outer shell 2d and not within drum 2, a continuous, cylindrical combustion chamber F2 is provided for drum 2 which is completely symmetrical with respect to drum axis A2, despite the different wall thicknesses of drum 2 at the top and bottom (see FIG. 2).

In addition to its 90° rocking movement, drum 2 is able to selectively or intermittently rotate 180° for the purpose of discontinuously emptying the molten combustion residues into a granulating tank 6 in a manner to be described in greater detail with reference to FIG. 2. A semicylindrical supporting and running semiannular rib 2e, having the shape of a segment of a circle, is provided on the semicylindrical lower part 2b to facilitate rotation of the drum. The external diameter 2f of rib 2e is the same as the external diameter of the upper drum part 2a, a feature which is particularly clearly visible in FIG. 2. Thus, during its 180° emptying rotation, the external diameter 2f of the fixed supporting and running rib 2e, which is preferably detachably disposed on the drum, initially rides on supporting rollers 7a, and then the outer diameter of the semicylindrical upper drum part 2a rides on the supporting rollers 7a, which are shown in FIG. 2.

The tiltable charging mechanism 4 is pivotably disposed on horizontally positioned trunnions 13 outside the rear end wall 2c of drum 2 wherein there is a central charging opening 12. Mechanism 4 can be titled by 90° through opening 12 in the direction of arrow R4 forwardly and into drum 2, as shown by the tilted position 4' of charging mechanism 4 indicated by the broken lines in FIG. 1. The container-like charging mechanism 4 serves to receive and charge drum 2 in a batchwise manner with solid waste materials and also with such materials stored in barrels 14. For this purpose, mechanism 4 is provided with a receiving plate 15 displaceable in plunger-like manner. Plate 15 has a downwardly projecting push rod 16 disposed in an axially displaceable manner in a guide sleeve 17 located on the bottom 4a of charging mechanism 4. When the charging mechanism is tilted into drum 2, the free lower end of push rod 16 is pivoted upwardly in a circle along arrow line R16 and into the charging position 16' indicated by the dashed lines in FIG. 1 where, together with the plate 15, the lower end of push rod 16 is adapted to be thrust forwardly by an axially movable operating rod 18. As a result, a barrel 14 located in front of plate 15, or waste material in charging mechanism 4, can be moved forwardly into the drum 2. The rear end of drum 2 is sealed by a fixed sealing casing 19, to prevent the penetration or infiltration of air. Casing 19 envelopes tiltable charging mechanism 4, operating rod 18 being guided in an axially displaceable manner by guide sleeve 20 tightly inserted in the casing rear wall 19a.

The stationary secondary combustion chamber is also lined with the refractory brick material 9 and has a base 5a which is vertically position on a frame 21 formed from steel structure sections. During the rocking movement of drum 2, chamber 5 is constantly in an outwardly directed, gas-tight communication with a gas outlet 24 in the upper part 2a of drum 2 by means of opening 22 in a lower gas inlet connection 23 of the secondary combustion chamber 5. The gas inlet connection 23 of the secondary combustion chamber 5 extends downwardly in a dome-like manner and is defined by two arcuate side plates 25 which embrace drum 2 from above. Side plates 25 are semicylindrical and are substantially coaxial with drum 2. These side plates are spaced from one another by the width W (in the direction of axis A2) of gas inlet 22 of secondary combustion chamber 5. The lower, cylindrically widened part of the gas inlet 22 is adapted, with regard to its size, shape and position, to accommodate the size, shape and rotational amplitude of the reciprocating gas outlet 24 when drum 2 is rocking during normal operation (see FIG. 2).

For the purpose of permitting displacement of the combustion from drum 2 into the secondary combustion chamber 5, combustion air nozzles 26 are provided in the lower part of chamber 5 and are connected to a corresponding manifold pipe 27 for feeding combustion air into chamber 5. The particular function of these nozzles 26 will be described in greater detail hereinafter in connection with the furnace operation. A burner 28, which can be operated with fuel oil, gas, or combustible liquid waste materials, is also provided in the lower part of the secondary combustion chamber 5 for maintaining the ignited state of the flue gases flowing as pyrolysis gases from drum 2 into chamber 5. An upper gas outlet 5b of chamber 5 channels the flue gases from furnace 1 into a downstream-connected unit, such as a radiant cooler. A sheet metal casing 5c surrounds the brick material 9 of secondary combustion chamber 5.

An immersion tube support or chute 29 is connected at its top ends 25a to the lower end of the two cylindrical side plates 25 of the combustion chamber inlet connection 23 (see FIG. 2) and lower end 29a of support 29 is immersed somewhat in a water bath 6a of a granulating tank 6, so that an undesired penetration of infiltrated cold air from the bottom into drum 2 or chamber 5 is prevented.

FIG. 2 is a vertical section through furnace 1 illustrating the external tight connection between the reciprocating gas outlet 24 of drum 2 and the gas inlet 22 of the stationary secondary combustion chamber 5. The vertical longitudinal median plane of furnace 1 is designated by line E1. FIG. 2 only shows the front cylindrical side plate 25, although two plates 25 are successively arranged along the drum axis A2. Plates 25 form a lower extension of the gas inlet connection 23 of chamber 5 lined with refractory material 9 and embrace in a dome-like manner from above the semicylindrical upper part 2a of drum 2. The sheet metal immersion chute 29 is connected from below to the two side plates 25, while two upper cylindrical edge portions 29b of chute 29 (only the front edge portion 29b can be seen in FIG. 2) are shaped to conform to the outer circumference P2 of the semicylindrical lower drum part 2b (see also FIG. 1). According to FIG. 1, the outer surface of the semicylindrical lower drum part 2b is provided with two semicylindrical shoulders 2g, whose outer circumference P2 has the same diameter as the semicylindrical upper drum part 2a. Shoulders 2g seal the upper part of immersion chute 29 against the penetration of air infiltrated from the outside.

In FIG. 2, drum 2 is shown in the mid-position of its rocking movement which has a rotational angle $\alpha$ which is typically 90°. The vertical axial plane E2 of drum 2 coincides with the vertical longitudinal median plane E1 of furnace 1 in FIG. 2. The gas outlet 24 of drum 2 is bounded on either side by two inclined, planar surfaces 30, 31, which form an angle $\gamma$ of 90° with respect to one another and whose apex S is located in the vertical axial plane E2 of drum 2 below drum axis A2. Surfaces 30 and 31 form the necessary opening for the gas outlet 24 of drum 2 within the thickness of the refractory material 9 in the upper drum part 2a. The semicylindrical lower drum part 2b which, with the semicylindrical upper drum part 2a forms two steps 2s located in the horizontal axial plane H2 of drum 2 and which, like the upper drum part 2a and including steps 2s, is enveloped by the sheet steel 2d, is essentially formed by the semicylindrical layer of a refractory lining 10 cooled by means of the water spray nozzles 11 (FIG. 1). Lining 10 is much thinner than the wall thickness of the upper drum part 2a lined with refractory material 9 and typically is only about a third of the thickness of material 9 of upper drum part 2a.

If, during the reciprocating movement having a rotational angle $\alpha$ of 90°, drum 2 is rotated to the left from the central position in plane E1 (see FIG. 2) by half the angle of rotation or 45°, as designated by $\beta$, to its left-hand limit position, the right-hand surface 30 of gas outlet 24 is simultaneously rotated into a generally vertical upper limit position, as indicated in FIG. 2 by the broken line 30a. If drum 2 is rotated to the right from it central position in plane E1 by half the angle of rotation $\beta$, or 45°, to its right-hand limit position, the left-hand surface 31 simultaneously rotates upwardly to the vertical upper limit position 31a, also shown by a broken line in FIG. 2. Thus, in their respective vertical limit positions 30a or 31a, the two surfaces 30, 31 of gas outlet 24 of drum 2 are generally aligned with the respective inner wall faces 22a, 22b of gas inlet connection 23 of secondary combustion chamber 5 which bound the gas inlet 22 thereof. Gas inlet 22 of chamber 5 has a rectangular cross-section, whose greatest width or longitudinal dimension extends at right angles to the longitudinal median plane E1 of furnace 1 and which conforms to the width of gas outlet 24 of drum 2 and the rotation angle $\alpha$ of 90°. Thus, gas outlet 24 of the drum 2 permits an unimpeded flow of pyrolysis gases from said drum into chamber 5, even when the drum and therefore its gas outlet 24 are in the right-hand and left-hand limit position of their reciprocating movement. The gas inlet 22 of the stationary secondary combustion chamber 5 is therefore constantly connected with the gas outlet 24 during the reciprocating movement of drum 2.

Periodically drum 2 performs a 180° rotation from its central position in the vertical plane E1 shown in FIG. 2 for the purpose of transfer of molten combustion residues from drum 2 to the water-filled granulating tank 6. As seen in FIG. 2, a counterclockwise emptying rotation of drum 2 takes place as shown by the directional arrow R2. Broken lines 30' and 31' of FIG. 2 show the position respectively of the two bounding surfaces 30, 31 of the then downwardly projecting combustion gas outlet 24 following a 180° emptying rotation of drum 2. Because of the relative position of immersion chute 29 and the asymmetrical cross-section of its upper part as shown in FIG. 2, all of the liquid combustion residues may be completely emptied from drum 2.

The operation of the combined combustion and melting furnace 1 will now be described in conjunction with a description of the combustion and melting phase.

1. Combustion phase

During this phase, solid waste materials, as well as solid or pasty materials stored in barrels 14 are fed in batches into the furnace 1 by means of the tiltable charging mechanism 4. The combustion air is blown through burner 3 into the front burner anted amber 8 of drum 2. An intense stirring of the waste materials takes place in drum 2 as a result of the 90° rocking movement thereof.

If waste materials are fed into furnace 1 which have a very high rate of combustion, the combustion air is no longer blown in through burner 3, but is instead blown into the secondary combustion chamber 5 either wholly or partly through nozzles 26. The waste materials in drum 2 consequently undergo pyrolysis, that is, a decomposition at high temperature or thermal fission, also called dry distillation. The resulting gases leave the drum 2 as pyrolysis gases through the upper gas outlet 24 and then flow into the secondary combustion chamber 5, where they are ignited. Thus, the combustion process is displaced from drum 2 into chamber 5 and only then is the heat liberated. As a result, the temperature in drum 2 drops, so that the pyrolysis of the material to be burned is slowed down. As a result, the units connected downstream of the furnace, such as waste heat boilers, flue gas cleaners and exhausters are supplied with a substantially constant flue gas flow. If the above-described step is not sufficient for attaining a constant flue gas flow, additional water can be fed into drum 2 via burner 3 for cooling purposes. Burner 28, by means of which the fuel or waste oil or gas is introduced into the secondary combustion chamber 5, serves to sustain the ignition of the pyrolysis gases.

2. Melting phase

As soon as the lower part 2*a* of drum 2 is filled with combustion residues of the preceding combustion phases, and optionally even with barrels 14, to such an extent that the drum can no longer be charged with waste materials, solvents or other liquid fuels, such as oils or water/oil mixtures are fed in through drum burner 3 and are burned in drum 2. As a result of the high temperatures produced, the solid combustion residues are melted and subsequently are emptied into the water-filled granulating tank 6 through the downwardly projecting combustion gas outlet 24 of drum 2 by an emptying rotation of the drum of 180°.

It is contemplated that changes and modifications may be made in the invention without departing from the spirit and scope thereof. Accordingly, the invention is not to be limited by what has been particularly shown and described except as indicated in the appended claims.

What is claimed is:

1. A combined combustion and melting furnace for solid, pasty and liquid waste materials comprising:

a drum rotatable on rollers about a longitudinal axis from a normally operative position and being adapted to be rocked about said longitudinal axis by a drive means, the waste material to be burned in said drum being stirred by the rocking motion, said drum having an upper portion and a lower portion;

a charging mechanism arranged outside a rear longitudinal end wall of said drum, said drum having a charging opening for the batchwise charging, by means of said charging mechanism, of the furnace with solid waste materials;

a burner for the liquid waste materials disposed on a burner anted amber fixed at a front longitudinal end of said drum;

a secondary combustion chamber having a gas inlet disposed at its base, said inlet connection being normally coupled to a gas outlet at the upper side of said drum, both when said drum is in its normally operative position and when it is being rocked;

a refractory lining disposed in said upper portion of said drum and on said burner anted amber;

a refractory lining disposed in said lower portion of said drum;

stationary water spray nozzles positioned outside said lower portion of said drum and being directed against the periphery of said drum; and a water-filled granulating tank positioned below said drum to which molten combustion residues are removed from said drum, said drum being selectively rotated by approximately 180° from its normally operative position so that the molten residues discharge through said gas outlet into said granulating tank.

2. The furnace according to claim 1, wherein:

said drum is substantially cylindrical and has on its outer circumference a step extending radially inwardly toward said longitudinal drum axis, said refractory lining on said lower portion of said drum having a thickness less than the thickness of said refractory lining on said upper portion of said drum, said refractory lining thicknesses differing by an amount substantially equal to the radial depth of said step; and wherein said drum has a cylindrical combustion chamber coaxial with said drum.

3. The furnace according to claim 2, wherein said step is disposed on a horizontally extending axial plane of said drum and wherein said upper and said lower drum portions are each semicylindrical and have different external diameters.

4. The furnace according to claim 2, and further comprising:

a semiannular supporting and running rib on said lower portion of said drum; and rollers positioned beneath said drum;

the radius of said rib being substantially equal to the radius of said upper drum portion, said rollers being adapted to support said rib and said upper drum portion when said drum is in its normal position, is being rocked, or is rotated for molten residue removal.

5. The furnace according to claim 1, wherein said burner is axially movable.

6. The furnace according to claim 1, wherein said charging mechanism comprises:

waste receiving means;

means tiltably connecting said waste receiving means to said rear end wall of said drum;

a receiving plate displaceable in plunger-like manner in said waste receiving means;

a push rod connected to said receiving plate and axially displaceable in a guide sleeve located on the bottom of said waste receiving means to selectively displace said receiving plate;

a fixed casing enveloping said charging mechanism for sealing said rear longitudinal end of said drum; and an operating rod extending through said casing arranged to move in a direction along said longitudinal axis;

whereby when said waste receiving means is tilted to discharge solid waste into said drum, said push rod and said operating rod are aligned so that said push rod is axially displaceable externally of said casing by means of said operating rod.

7. The furnace according to claim 1 and further comprising:

opposed arcuate side plates extending downwardly from said secondary combustion chamber adjacent said gas inlet, said side plates enveloping in dome-like manner a portion of said drum, there being two such side plates on each side of said drum, said side plates on each side being longitudinally spaced in the direction of said axis by the width of said gas inlet; and an emmersion chute connected between said side plates and said granulating tank.

8. The furnace according to claim 1, wherein said secondary combustion chamber comprises at least one combustion air nozzle and a burner disposed at the base thereof for fuel oil, gas or combustible liquid waste materials.

* * * * *